United States Patent [19]

Vernon et al.

[11] 4,434,045

[45] Feb. 28, 1984

[54] PROCESS FOR CONVERTING PETROLEUM RESIDUALS

[75] Inventors: Lonnie W. Vernon, Baytown; Fritz E. Jacobs, Houston, both of Tex.

[73] Assignee: Exxon Research and Engineering Co., Florham Park, N.J.

[21] Appl. No.: 336,977

[22] Filed: Jan. 4, 1982

[51] Int. Cl.[3] ..... C10G 47/00

[52] U.S. Cl. ..... 208/107; 208/56

[58] Field of Search ..... 208/107, 157, 56, 145

[56] References Cited

U.S. PATENT DOCUMENTS

| | | | |
|---|---|---|---|
| 2,843,530 | 7/1958 | Langer et al. | 208/56 |
| 2,953,513 | 9/1960 | Langer | 208/56 |
| 3,147,206 | 9/1964 | Tulleners | 208/56 |
| 3,252,888 | 5/1966 | Langer et al. | 208/56 |
| 3,369,994 | 2/1968 | Slater et al. | 208/107 |
| 3,867,275 | 2/1975 | Gleim et al. | 208/8 LE |
| 4,252,634 | 2/1981 | Khulbe et al. | 208/107 X |
| 4,292,168 | 9/1981 | Derbyshire et al. | 208/145 X |
| 4,298,457 | 11/1981 | Oblad et al. | 208/107 |
| 4,389,303 | 6/1983 | Simo et al. | 208/107 |

*Primary Examiner*—Delbert E. Gantz
*Assistant Examiner*—Geo. Schmitkons
*Attorney, Agent, or Firm*—Wayne Hoover

[57] ABSTRACT

An improved process for hydrocracking petroleum residuals wherein total conversion and the yield of lower boiling range products are increased. The hydrocracking is accomplished in the presence of a hydrogen donor solvent and molecular hydrogen. The conversion is accomplished at a pressure within the range from about 1500 to about 2500 psig and at a temperature within the range from about 800°to about 850° F. Operation at these conditions is essential to achieving the increased conversion and the increased yield of lower boiling liquid products.

While the present invention has been described and illustrated by reference to particular embodiments thereof, it will be appreciated by those of ordinary skill in the art that the same lends itself to variations not necessarily illustrated herein. For this reason, then, references should be made solely to the appended claims for purposes of determining the true scope of the present invention.

11 Claims, 4 Drawing Figures

FIGURE I

PROCESS FOR CONVERTING PETROLEUM RESIDUALS

BACKGROUND OF THE INVENTION

This invention relates to an improved process for converting petroleum residuals. More particularly, this invention relates to an improved process for hydrocracking petroleum residuals.

Heretofore, several processes have been proposed for converting or demetalizing petroleum residuals. Such conversions and demetalizations may be accomplished over a relatively broad range of pressures and, generally, such conversions or demetalizations are accomplished at temperatures known to be effective in hydrocracking operations. It is known to effect such conversions or demetalizations in the presence of a solvent capable of donating hydrogen at the conditions employed to effect the conversion or demetalization and molecular hydrogen may or may not be present. The processes which have been proposed, heretofore, are used primarily for the purpose of upgrading the petroleum residuals such that the converted and demetalized product can satisfactorily be used as a feedstock to various petroleum processes such as catalytic cracking, hydrocracking and the like. As a result, however, the processes proposed heretofore have not resulted in significant conversion of the petroleum residual or in significant production of lighter boiling materials, particularly those in the naptha boiling range. The need, then, for an improved process for converting petroleum residuals to lighter products which may be used directly as a fuel is believed readily apparent.

SUMMARY OF THE INVENTION

It has now been discovered that the foregoing and other disadvantages of the prior art processes can be avoided with the method of the present invention and an improved process for converting petroleum residuals provided thereby. It is, therefore, an object of this invention to provide an improved process for the conversion of petroleum residuals. It is another object of this invention to provide such a conversion process wherein the total conversion of residuals is increased. It is still a further object of this invention to provide such an improved process wherein the relative yield of lighter boiling materials is increased. The foregoing and other objects and advantages will become apparent from the description set forth hereinafter and from the drawings appended thereto.

In accordance with the present invention, the foregoing and other objects and advantages are accomplished by converting a petroleum residual in the presence of molecular hydrogen and a hydrogen donor solvent at an elevated pressure and temperature. As pointed out more fully hereinafter, the total conversion of petroleum residual to lower boiling materials is increased by controlling the pressure within a relatively narrow critical range and by effecting the conversion in the presence of a hydrogen donor solvent containing at least 0.8 weight percent donatable hydrogen. As also pointed out more fully hereinafter, continuous operation of the process can be maintained by controlling the concentration of aromatic and hydroaromatic materials in the solvent relative to the amount of paraffinic materials therein.

DETAILED DESCRIPTION OF THE INVENTION

Figure 1:
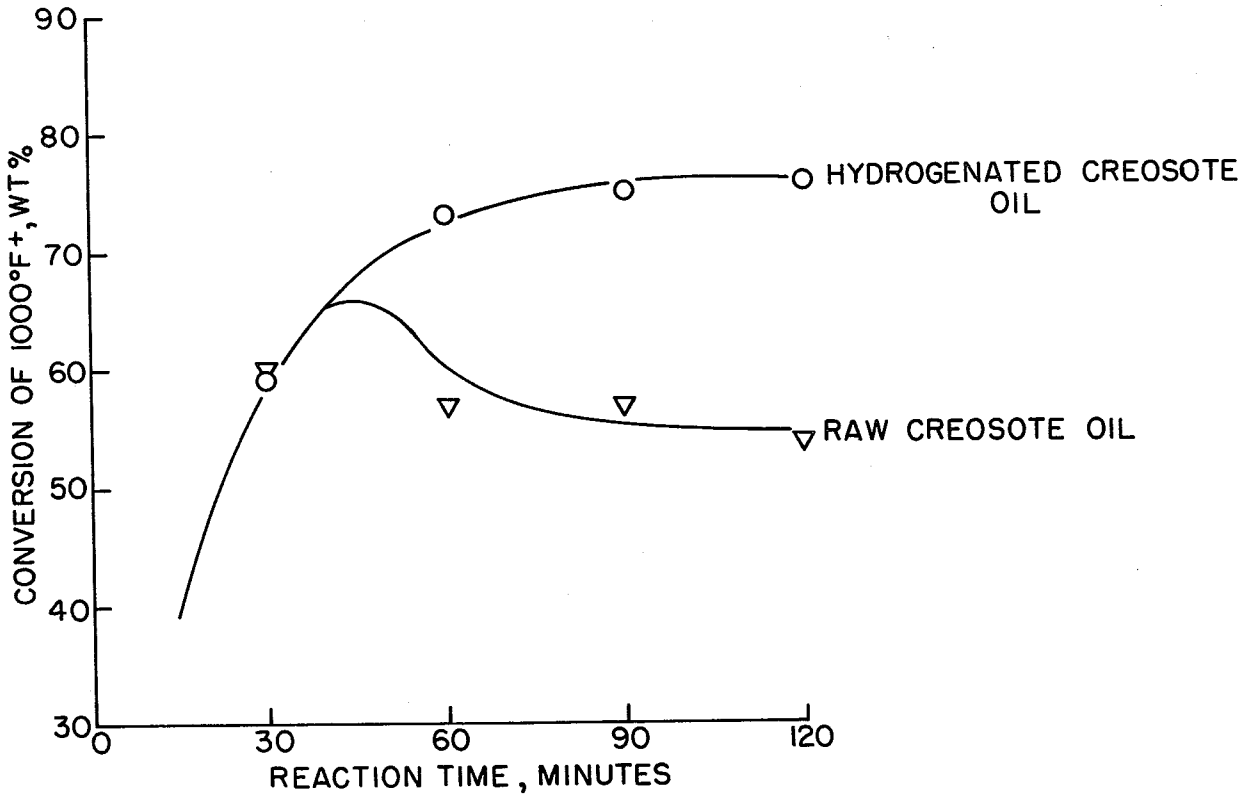
FIG. 1 is a plot comparing total conversion as a function of holding time for two different solvents.

As indicated, supra, the present invention relates to an improved process for converting petroleum residuals to lower boiling materials wherein total conversion of the petroleum residual and the yield of lighter boiling materials is increased. As indicated more fully hereinafter, it is critical to the present invention that the liquefaction be accomplished in the presence of a solvent containing at least about 0.8 weight percent donatable hydrogen at the time the solvent is fed to the conversion step; that the ratio of paraffinic materials to aromatic and hydroaromatic materials in the solvent be controlled such that the ratio is within the range from about 0:1 to about 0.5:1; and that the conversion be accomplished in the presence of molecular hydrogen at a partial pressure within the range from about 1500 to about 2500 psia.

In general, the method of the present invention can be used to convert any petroleum residual material. For purposes of this invention, petroleum residual material shall mean the material remaining after a crude oil has been processed to separate lower boiling constitutents. In general, the petroleum residuals will have an initial boiling point within the range from about 650 to about 1050° F. and will be normally solid at atmospheric conditions. The petroleum residuals will, however, be liquid at the conditions used to effect the conversion. The petroleum residuals may be derived or separated from essentially any crude including those generally classed as aromatic, napthenic and paraffinic. In general, the petroleum residuals useful in the method of this invention will be bottoms from a vacuum distillation column but the same could be any residual from a carbonaceous material having an initial boiling point within the range hereinbefore noted that is also liquid at the conditions used to effect the conversion.

In the method of the present invention, the petroleum residual will be combined with a solvent or diluent capable of donating hydrogen at the conditions employed to effect the conversion and containing at least 0.8 weight percent donatable hydrogen. The solvent may be a pure component but is preferably a mixture of components, some of which are capable of donating hydrogen and some of which are not. In a most preferred embodiment, at least a portion of the solvent will be a distillate fraction separated from the conversion liquid product and, depending on the particular petroleum residual subjected to conversion, this distillate fraction may be separately hydrotreated to produce components therein which are capable of donating hydrogen during conversion. In this regard, it should be noted that when the petroleum residual is highly aromatic, the distillate fraction will, generally, contain sufficient aromatic materials, that can be converted via hydrotreating to corresponding hydroaromatic materials to provide all of the donatable hydrogen required in the solvent. When the petroleum residuals are primarily napthenic or paraffinic, however, it will, generally, be necessary to add aromatic and/or hydroaromatic materials to the distillate fraction which has been separated from the conversion product for use as a solvent. Also, it may be necessary, particularly with paraffinic crudes, to remove at least a portion of the paraffinic material in the solvent fraction. When aromatics are added, separate hydrotreating will be necessary to convert at least a portion of the aromatics to corresponding hydroaromatics. When hydroaromatics are added directly, however, such separate hydrotreating will not be necessary. In this regard, it should be noted that an important feature of the present invention is the discovery that paraffins are the principal contributor to coke formation during conversion and that the presence of aromatics and hydroaromatics during such conversions either inhibit the formation of coke or solubilize the same to avoid plugging during conversion operations. Also, in a most preferred embodiment, use of a solvent having characteristics similar to the characteristics of the conversion product increases total conversion of the petroleum residuals. The use of a solvent which is a distillate fraction containing a relatively broad range of compounds is, therefore, particularly advantageous and when the petroleum residual is an aromatic, the solvent should contain aromatic materials, when the petroleum residual is napthenic, the solvent should contain napthenic materials and when the residual is paraffinic, the solvent should contain paraffins.

Compounds which will donate hydrogen during liquefaction are believed well-known in the prior art and many are described in U.S. Pat. No. 3,867,275. These include the indanes, the dihydronapthalenes, the $C_{10}$–$C_{12}$ tetrahydronapthalenes, the hexahydroflourines, the dihydro-, tetrahydro-, hexahydro- and octahydrophenanthrenes, the $C_{12}$–$C_{13}$ acid napthenes, the tetrohydro-, hexahydro-, and decahydropyrenes, the di-, tetra-, and octahydroanthracenes, and other derivatives of partially saturated aromatic compounds. Particularly effective mixed solvents for use in the present invention include mixtures comprising a distillate fraction separated from the conversion product which is separately hydrotreated to convert at least a portion of the aromatic materials contained therein to the corresponding hydroaromatic components, hydrogenated creosote oils and hydrogenated catalytic cracking cycle stock and mixtures of such mixtures. Particularly effective solvents include distillate fractions of such mixtures having an initial boiling point within the range from about 400° to about 650° F. and a final boiling point within the range from about 850° to about 1050° F. which have been hydrogenated so as to contain at least 25 weight percent of hydrogen donor species and preferably at least 50 weight percent of such species.

In general, the petroleum residual and the solvent will be combined in a solvent-to-residual weight ratio within the range from about 0.5:1 to about 2:1. The combination may be effected in accordance with any procedure obvious to one of ordinary skill in the art which will be effective in uniformly distributing the petroleum residual throughout the solvent. Best results are generally, however, obtained at elevated temperatures within the range from about 100° to about 350° F. in suitable mixing equipment.

After the mixture of petroleum residual and solvent is prepared, the same is then subjected to conversion at a temperature within the range from about 800° to about 850° F. in the presence of molecular hydrogen. Generally, molecular hydrogen will be present at a concentration within the range from about 4 to about 8 weight percent based on petroleum residual and the partial pressure of molecular hydrogen will be within the range from about 1500 to about 2500. The mixture will be held at these conditions for nominal holding time within the range from about 30 to about 120 minutes.

Another important feature of the present invention is the discovery that when a properly selected solvent is used the nominal holding time in either a batch or continuous operation can be extended when the hydrogen partial pressure is maintained within the critical range heretofore noted without a reduction in total conversion of the petroleum residual which has been experienced in processes heretofore proposed. In this regard, it should be noted that total conversion as used herein means the percentage of the petroleum residual which is converted to materials having boiling points less than the initial boiling point of the petroleum residual subjected to conversion. This discovery is illustrated in FIG. 1. Referring then to FIG. 1, curve 1 is a plot of conversion vs. contacting time when a heavy Arab resid was treated in the presence of a non-donor solvent at 840° F. at a solvent-to-residual ratio of 1.5:1 and at a hydrogen partial pressure of 2000 psia. Curve 2 is a plot of conversion vs. holding time at the same conditions except that a solvent capable of donating hydrogen during conversion was employed. In the runs used to generate curve 2, hydrogenated creosote oil was used as a solvent at a solvent-to-residual ratio of 1.5:1. As will be apparent from FIG. 1, significantly increased conversions can be achieved when operating in accordance with the method of the present invention.

While the inventors do not wish to be bound by any particular theory, it is believed that when the hydrogen partial pressure is increased during conversion of a petroleum residual to a value within the critical range heretofore specified in the presence of a solvent capable of donating hydrogen at the conditions of the conversion, free radicals which have formed at the more severe conditions associated with increased holding time in processes proposed heretofore are scavenged by reaction with hydrogen contributed either by the donor solvent or from the molecular hydrogen. Surprisingly, however, a reduction in total conversion has been experienced when the hydrogen partial pressure is increased above about 2500 psia.

While also not wishing to be bound by any particular theory, it is believed that the solvent must contain a sufficient amount of donatable hydrogen to provide at least 0.4 weight percent of such hydrogen based on petroleum resid in the initial mixture of petroleum resid and solvent. It is also believed necessary that the solvent contain at least 50 weight percent aromatic plus hydroaromatic components to prevent plugging as the result of coke formation during conversion.

During the conversion, at least a portion of the petroleum residual will be converted to a normally gaseous product and at least a portion will be converted to a normally liquid product. Generally, the liquid product will have an initial boiling point at or near the atmospheric temperature and a final boiling point equal to the initial boiling point of the petroleum residual and within the range from about 650° to about 1050° F. The liquid product may then be fractionated into any desired fractions for further upgrading or direct use as an end product. Unconverted material; i.e., material having a boiling point equal to or greater than the initial boiling point of the petroleum residual subjected to conversion may either be recycled to the conversion step, burned directly as a fuel or discarded.

In general, at least a portion of the liquid product will be separated and recycled to provide at least a portion of the solvent required to effect the conversion. When the separated fraction contains sufficient aromatics and/or hydroaromatics, it will not be necessary to combine this fraction with any extraneous solvent fractions. To the extent that the separated fraction contains primarily aromatics, this fraction may be subjected to hydrotreating to convert at least a portion of the aromatics to a corresponding hydroaromatic material. When this fraction does not, however, contain sufficient aromatic or hydroaromatic materials, it will be necessary to combine the same with an extraneous solvent fraction to produce a solvent having an aromatic/hydroaromatic concentration within the ranges heretofore specified. A catalytic cracking recycle oil is a particularly preferred extraneous fraction to employ since this oil is particularly high in aromatic materials. Creosote oils may also be used as an extraneous solvent fraction since these oils, too, generally, contain significant concentrations of aromatic materials.

PREFERRED EMBODIMENT

In a preferred embodiment of the present invention, the petroleum residual will be converted at a temperature within the range from about 820° to about 845° F. in the presence of a solvent capable of donating at least about 1.0 weight percent hydrogen, based on petroleum resid in the initial mixture of petroleum resid and solvent, and in the presence of molecular hydrogen at a hydrogen partial pressure within the range from about 1700 to about 2200 psia. In the preferred embodiment, the petroleum residual will be maintained at these conditions for a nominal holding time within the range from about 60 to about 90 minutes. Also in the preferred embodiment, the solvent will contain at least 60 weight percent aromatic and hydroaromatic components and the ratio of paraffinic materials to aromatic and hydroaromatic materials will be within the range from about 0:1 to about 0.25. In a preferred embodiment, the aromatic and hydroaromatic materials may be contained in a distillate fraction of the conversion liquid product or obtained by hydrotreating such a fraction containing aromatic materials or the same may be obtained from alternate sources such as a catalytic cracking cycle oil or a creosote oil. In a most preferred embodiment, however, a petroleum residual containing sufficient aromatic materials will be subjected to liquefaction and a sufficient concentration of aromatic materials will be present in a distillate fraction separated from the conversion liquid product and the required hydroaromatic concentration will be provided by hydrotreating this fraction to convert at least a portion of the aromatic materials to corresponding hydroaromatic materials. Any suitable catalyst may be used during the hydrotreating.

Figure 2:
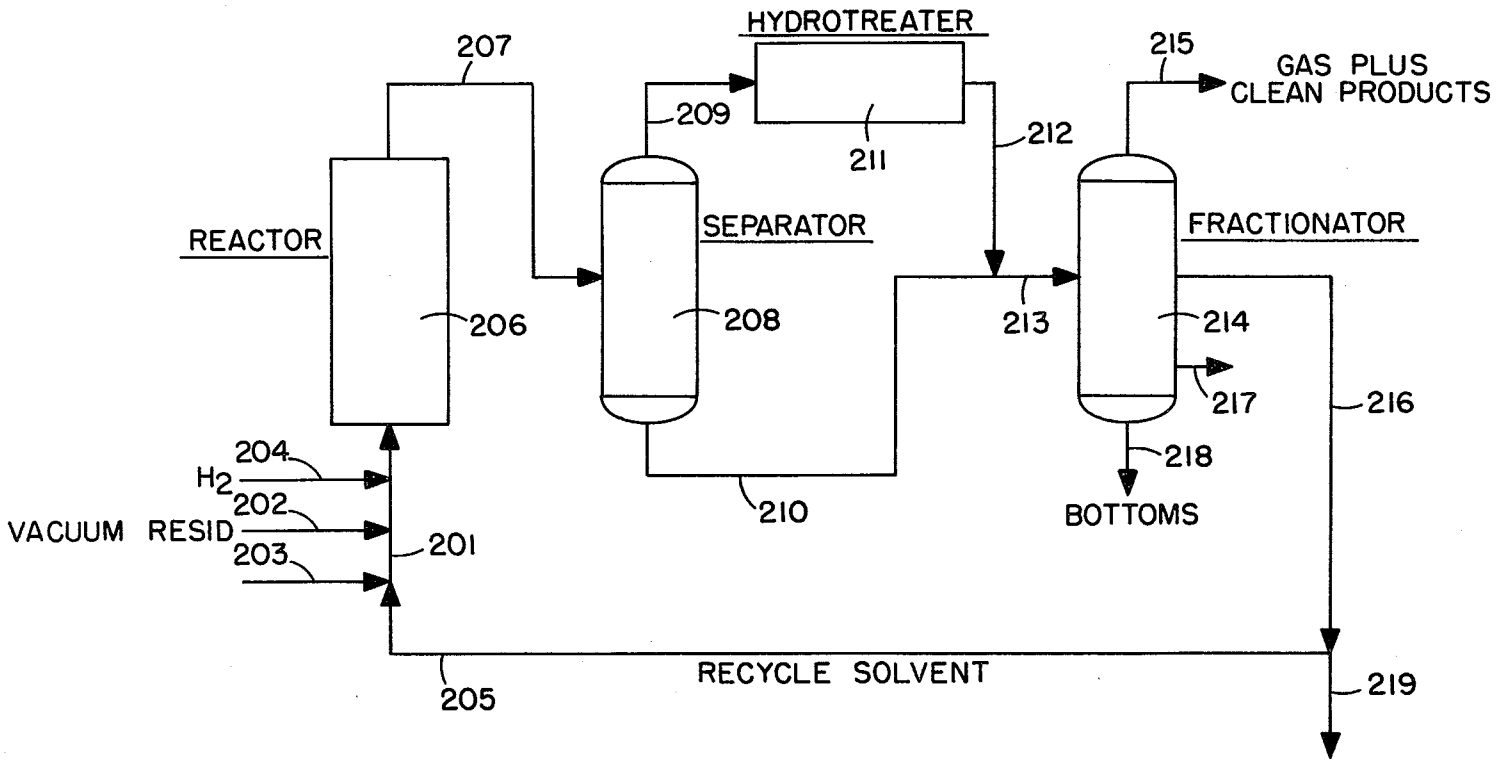
FIG. 2 is a schematic flow diagram of a process within the scope of the present invention.

It is believed that the invention will be even better understood by reference to attached FIG. 2 which illustrates a particularly preferred embodiment. Referring then to FIG. 2, a petroleum resid, a suitable solvent and molecular hydrogen are fed into mixing manifold 201 through lines 202, 203 and 204, respectively. The petroleum resid will be introduced at a temperature above the temperature at which the same is liquid and pumpable, generally at a temperature within the range from about 100° to about 350° F. In general, any suitable solvent may be introduced through line 203 to effect "start up" of a commercial operation but at steady state recycle solvent will be introduced through line 205 and only makeup or extraneous solvent will be introduced through line 203. Extraneous solvent will, of course, be introduced when the recycle solvent introduced through line 205 is deficient in aromatic and/or hydroaromatic content. To the extent that hydroaromatic materials are introduced through line 203, the solvent will, preferably, be a hydrogenated creosote oil or a hydrogenated catalytic cracking cycle stock. In general, the solvent and molecular hydrogen will be preheated to a temperature within the range from about 800° to about 850° F. In general, the solvent will contain sufficient donatable hydrogen to provide at least 0.4 weight percent donatable hydrogen based on petroleum resid in the initial mixture and the combined aromatic/hydroaromatic concentration in the solvent will be at least 50 weight percent. The solvent will be combined with a petroleum resid in a ratio within the range from about 0.5:1 to about 2:1, preferably from about 1:1 to about 1.5:1 and hydrogen will be added at a rate within the range from about 4 to about 8 weight percent based on petroleum residual in the initial mixture.

After mixing in mixing manifold 201, the petroleum resid, solvent and molecular hydrogen mixture is fed to conversion reactor 206. In the conversion reactor, the mixture is heated to a temperature within the range from about 800° to about 850° F. at a hydrogen partial pressure within the range from about 1500 to about 2500 psia and at a total pressure within the range from about 1800 to about 2800 psia. The nominal holding time in conversion reactor 206 will range from about 30 to about 120 minutes. In the conversion reactor, at least a portion of the petroleum resid will be converted to a normally gaseous product and at least a portion will be converted to a normally liquid product. Generally, at least a portion of the petroleum resid will remain unconverted.

In the embodiment illustrated, the entire conversion product is withdrawn through line 207 and passed to a first separator 208. In the first separator, a product containing the normally gaseous product and all of the liquid product which is to be recycled as solvent is separated overhead through line 209 and a bottoms product is separated through line 210.

In those embodiments where the recycle solvent will contain aromatics, the fraction withdrawn overhead through line 209 is passed to hydrotreater 211. In the hydrotreater, at least a portion of the aromatic materials are converted to corresponding hydroaromatic materials. Such conversion is believed to be well known in the prior art. Normally, such hydrotreatment will be accomplished at a temperature within the range from about 600° F. to about 950° F., preferably at a temperature within the range from about 650° F. to about 800° F. and at a pressure within the range from about 650 to about 2000 psia, preferably 1000 to about 1500 psia. The hydrogen treat rate during such hydrotreating generally will be within the range from about 1000 to about 10,000 scf/bbl. Any of the known hydrogenation catalyst may be employed, but a "nickel moly" catalyst is most preferred.

In the embodiment illustrated, then, the hydrotreated fraction is withdrawn through line 212 and recombined with the bottoms fraction from separator 208 in line 213. The recombined fractions are then passed to a second separator 214.

In the second separator 214, products boiling below the initial boiling point of the solvent fraction, including normally gaseous materials, are separated overhead through line 215, a fraction, at least a portion of which is intended for use as recycle solvent, is withdrawn through line 216, a fraction having an initial boiling point equal to the higher boiling point of the solvent fraction is withdrawn through line 217 and a bottoms product generally having an initial boiling point equal to the initial boiling point of the petroleum resid subjected to conversion is withdrawn through line 218. In general, the fraction intended to be recycled as solvent will have an initial boiling point within the range from about 400° to about 650° F. and preferably an initial boiling point within the range from about 500° to about 650° F. and, generally, a final boiling point within the range from about 850° to about 1050° F. and preferably a final boiling point within the range from about 950° to about 1050° F. To the extent that this fraction exceeds the amount of solvent required, a portion thereof may be withdrawn as product through line 219 and the remainder recycled as solvent through line 205.

It will be appreciated that while hydrotreating has been illustrated on a relatively broad boiling range product and between a first and second separator, the hydrotreating could be accomplished after the solvent fraction has been separated from the second separator through line 216. As is well known in the prior art, however, hydrogenation does alter the boiling range of the solvent and further separation after hydrogenation affords better control over the boiling range of the solvent fraction. As a result, operation in the manner illustrated in the Figure is preferred.

The overhead product withdrawn through line 215 may be further separated into a normally gaseous product and a liquid product boiling, generally, in the naptha range. The gas may be scrubbed to remove impurities and used as a pipeline gas or as a process fuel. The naptha fraction may be further upgraded in accordance with well-known procedures to yield a high quality gasoline. The material withdrawn through line 219 boils, generally, within the known fuel oil ranges and may be used as such or further upgraded and used either as a diesel fuel or as a fuel oil. The material withdrawn through line 217 boils, generally, within the vacuum gas oil range and may be used as such or further upgraded or converted to different boiling range materials. The bottoms product withdrawn through line 218 may be at least partially recycled to the conversion reactor, burned for fuel value or discarded.

Having thus broadly described the present invention and a preferred embodiment thereof, it is believed that the same will become more apparent by reference to the following examples. It will be appreciated, however, that the examples are presented solely for purposes of illustration and should not be construed as limiting the invention.

EXAMPLE 1

Figure 3:
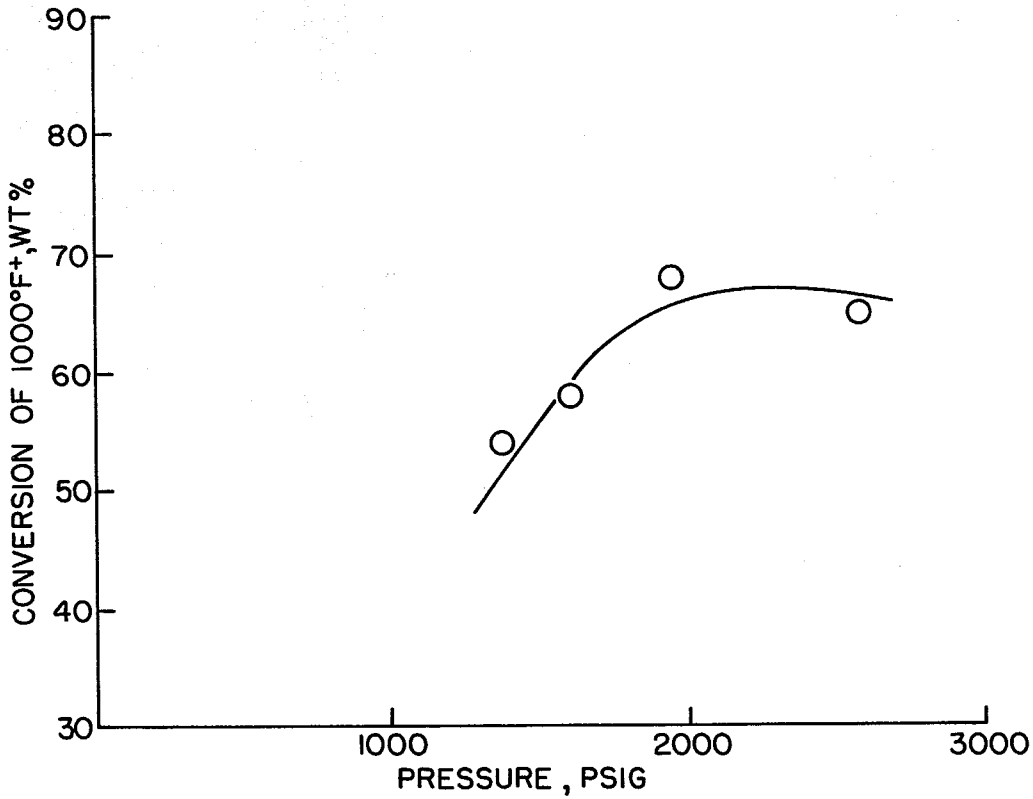
FIG. 3 is a plot showing total conversion as a function of pressure for a given solvent.

In this example, four runs were completed in an autoclave using a vacuum resid from a heavy Arab crude oil having an initial boiling point of 1000° F. to determine the effect of hydrogen partial pressure on conversion. In each run, a raw creosote oil was used. The solvent was used at a ratio of 1.5:1 based on petroleum residual in the initial blend. The solvent was, then, capable of donating 2.4 weight percent hydrogen based on petroleum resid in the initial mixture. The solvent contained essentially no paraffinic materials and, therefore, the ratio of paraffins to total aromatics plus hydroaromatics was 0. The hydrogen partial pressure was varied between about 1300 and about 2500 psig. After 90 minutes at 820° F. the total conversion, based on petroleum resid was determined. For convenience, the pressures employed and the total conversions obtained are tabulated below and for purposes of easy comparison, the total conversion as a function of pressure is plotted in FIG. 3 for RCO solvent.

| Run Number | Approximate Pressure, psig | Total Conversion Wt. % on Resid |
|---|---|---|
| 1 | 1300 | 54 |
| 2 | 1500 | 58 |
| 3 | 2000 | 68 |
| 4 | 2500 | 64 |

EXAMPLE 2

Figure 4:
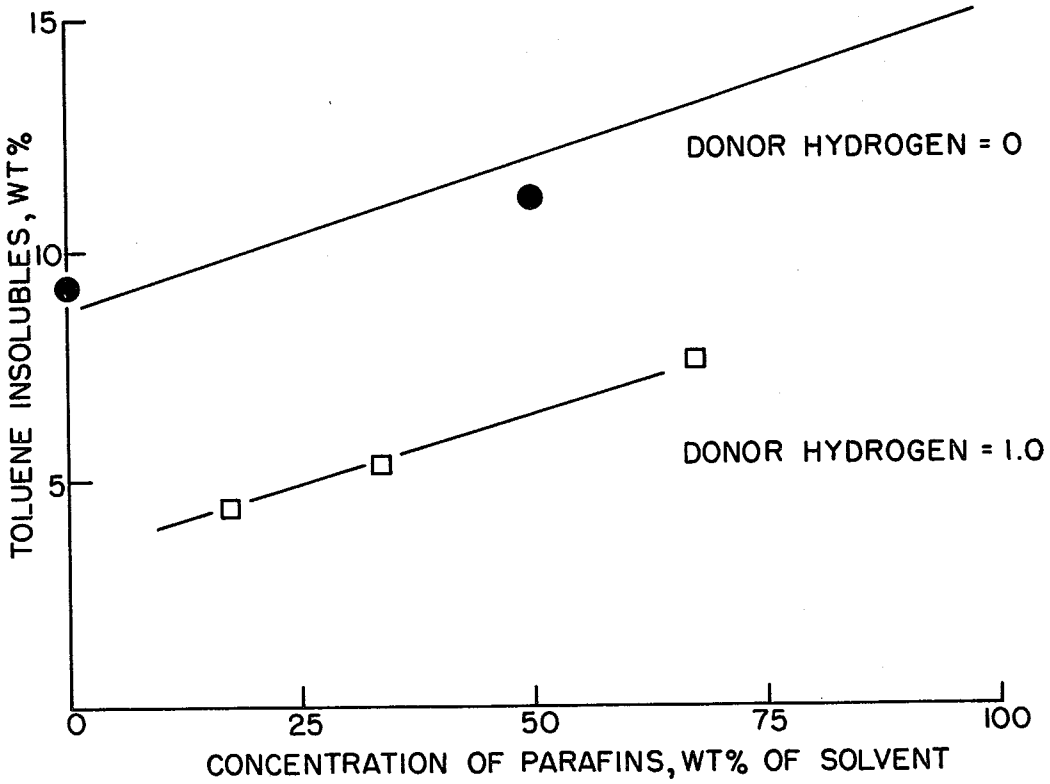
FIG. 4 is a plot showing the amount of coke produced during operation of the process of this invention as a function of the ratio of paraffinic content to the aromatic and hydroaromatic content of the solvent.

In this example, a series of runs were completed using the same vacuum resid used in Example 1 at a hydrogen partial pressure of 2000 psig at a temperature of 840° F. and at a nominal holding time of 60 minutes. The composition of the solvent was, however, varied in each run to determine the effect of solvent composition on the amount of coke make. At completion of experiment, the amount of coke actually prepared or generated was determined. The critical parameters relating to the composition of each solvent and the amount of coke generated is summarized and plotted in FIG. 4.

EXAMPLE 3

In this example, a heavy Arab vacuum resid was converted in a continuous unit using a hydrogenated creosote oil. The hydrogenated creosote oil contained 1.6 weight percent donatable hydrogen and was used in a solvent to resid ratio of 1.5:1. At this ratio, the solvent was capable of donating 2.4 weight percent hydrogen based on resid. The run was completed at 2000 psig at a space velocity of 0.75 v/hour/v and at a hydrogen treat rate of 4500 scf/bbl. The runs were completed at two different temperatures; viz., 840° and 845° F. The total conversion and product yields are tabulated in the table below.

| Reactor Temperature °F. | 840 | 845 |
|---|---|---|
| Yields, Wt % | | |
| $C_1$–$C_3$ | 10 | 12 |
| $C_4$–350° F. | 23 | 25 |
| 350–650° F. | 25 | 29 |
| 650–1000° F. | 19 | 12 |
| CONVERSION OF 1000° F.+, WT % | 77 | 78 |

As will be apparent from the foregoing, particularly when viewed in light of FIG. 1, relatively high total conversions of a petroleum residual can be achieved when operating in accordance with the method of the present invention. As will also be apparent, the yield of lighter boiling range materials is significantly higher than has been achieved with processes heretofore proposed. The method of the present invention, then, offers an improved process for converting petroleum residuals to in-use products.

Having thus described and illustrated the invention, what is claimed is:

1. A process for converting petroleum residuals comprising the steps of:

(a) combining a petroleum residual with a solvent comprising materials selected from the group consisting of paraffinic, aromatic and hydroaromatic materials such that the ratio of paraffinic materials to aromatic and hydroaromatic materials is within the range from about 0:1 to about 0.5:1 and at least 0.8 weight percent donatable hydrogen in a concentration sufficient to provide at least 0.4 weight percent donatable hydrogen based on petroleum residual in the initial mixture;

(b) converting the mixture from step (a) in the presence of molecular hydrogen at a hydrogen partial pressure within the range from about 1500 to about 2500 psig and at a temperature within the range from about 800° to about 850° F. for a nominal holding time within the range from about 30 to about 120 minutes; and (c) recovering a normally liquid product from the conversion step.

2. The process of claim 1 wherein at least a portion of the solvent is a distillate fraction separated from the normally liquid product from the conversion.

3. The process of claim 1 wherein the ratio of paraffinic material to aromatic and hydroaromatic material is within the range from about 0:1 to about 0.25:1.

4. The process of claim 1 wherein the petroleum residual is a vacuum residual separated from a paraffinic crude and having an initial boiling point within the range from about 950° to about 1050° F. and wherein a hydrogenated creosote oil is used as at least a portion of the solvent.

5. The process of claim 1 wherein the petroleum residual is a vacuum residual having an initial boiling point within the range from about 950° to about 1050° F. separated from an aromatic crude.

6. The process of claim 5 wherein a distillate fraction having an initial boiling point within the range from about 400° to about 650° F. and a final boiling point within the range from about 850° to about 1050° F. is separated from the conversion product, hydrotreated to convert at least a portion of the aromatic components thereof to corresponding hydroaromatic components and used as the solvent.

7. The process of claim 6 wherein the separated fraction is the sole solvent used.

8. The process of claim 1 wherein the petroleum residual is a vacuum residual separated from a napthenic crude and a hydrogenated catalytic cracking recycle oil is used as at least a portion of the solvent.

9. The process of claim 1 wherein the petroleum residual is a vacuum residual separated from a napthenic crude and having an initial boiling point within the range from about 950° to about 1050° F. and wherein a hydrogenated creosote oil is used as at least a portion of the solvent.

10. The process of claim 1 wherein the petroleum residual is a vacuum residual separated from a paraffinic crude and a hydrogenated catalytic cracking recycle oil is used as at least a portion of the solvent.

11. A process for converting petroleum residuals comprising the steps of:

(a) combining a petroleum residual with a solvent comprising materials selected from the group consisting of paraffinic, aromatic and hydroaromatic materials such that the ratio of paraffinic materials to aromatic and hydroaromatic materials is within the range from about 0:1 to about 0.25:1 and at least 1.0 weight percent donatable hydrogen in a concentration sufficient to provide at least 0.4 weight percent donatable hydrogen based on petroleum residual in the initial mixture;

(b) converting the mixture from step (a) in the presence of molecular hydrogen at a hydrogen partial pressure within the range from about 1700 to about 2200 psig and at a temperature within the range from about 820° to about 845° F. for a nominal holding time within the range from about 30 to about 120 minutes; and (c) recovering a normally liquid product from the conversion step.

* * * * *